US008371581B2

(12) United States Patent
Teluob et al.

(10) Patent No.: US 8,371,581 B2
(45) Date of Patent: Feb. 12, 2013

(54) METHOD OF DETECTING OPEN MAILPIECES SUCH AS NON-WRAPPED MAGAZINES

(75) Inventors: Jean-Marc Teluob, Cornas (FR); Stephane Ambroise, Serves (FR)

(73) Assignee: Solystic, Gentilly Cedex (FR)

( * ) Notice: Subject to any disclaimer, the term of this patent is extended or adjusted under 35 U.S.C. 154(b) by 327 days.

(21) Appl. No.: 12/811,041

(22) PCT Filed: Apr. 23, 2010

(86) PCT No.: PCT/FR2010/050781

§ 371 (c)(1),
(2), (4) Date: Jun. 28, 2010

(87) PCT Pub. No.: WO2010/125286

PCT Pub. Date: Nov. 4, 2010

(65) Prior Publication Data

US 2011/0052362 A1 Mar. 3, 2011

(30) Foreign Application Priority Data

Apr. 28, 2009 (FR) ..... 09 52779

(51) Int. Cl.
*B65H 7/02* (2006.01)

(52) U.S. Cl. ..... 271/265.04; 271/265.02

(58) Field of Classification Search ..... 271/265.04, 271/265.02; 414/795.5, 788.7
See application file for complete search history.

(56) References Cited

U.S. PATENT DOCUMENTS 4,397,460 A * 8/1983 Milanes et al. ..... 271/263
4,733,226 A * 3/1988 Kasuya et al. ..... 340/674
(Continued)

FOREIGN PATENT DOCUMENTS

DE 202007016722 U1 3/2008
FR 2546083 A1 11/1984
(Continued)

OTHER PUBLICATIONS

French Search Report Dec. 17, 2009 with partial English translation of search report.

(Continued)

*Primary Examiner* — Michael McCullough
*Assistant Examiner* — Howard Sanders
(74) *Attorney, Agent, or Firm* — Sughrue Mion, PLLC

(57) ABSTRACT

The method of detecting a mailpiece of the open mailpiece type such as a non-wrapped magazine consists in causing the mailpiece (3) to pass on edge through a first conveyor (2A) arranged to move the mailpiece (3) by nipping it while holding it tightly over substantially the entire height of the mailpiece, then to pass on edge through a second conveyor (2B) arranged to move the mailpiece (3) by nipping it while leaving a top end (3B) of the mailpiece free to fan out. Two measurements are taken of the thickness of the mailpiece (3) respectively when the mailpiece is in the first conveyor (2A) and when it is in the second conveyor (2B), for the purpose of determining, by differentially comparing the two measurements, whether the mailpiece is an open mailpiece.

12 Claims, 2 Drawing Sheets

U.S. PATENT DOCUMENTS

| | | | | |
|---|---|---|---|---|
| 5,114,128 | A * | 5/1992 | Harris et al. | 270/1.03 |
| 5,134,834 | A * | 8/1992 | Hayduchok | 53/492 |
| 5,331,151 | A * | 7/1994 | Cochran et al. | 250/223 R |
| 6,817,610 | B2 * | 11/2004 | Rompe | 271/265.04 |
| 7,365,331 | B2 | 4/2008 | Moulin et al. | |
| 7,500,554 | B2 | 3/2009 | Schererz | |
| 2001/0042956 | A1 * | 11/2001 | Minoru et al. | 271/265.04 |
| 2004/0213940 | A1 * | 10/2004 | Greenhill | 428/40.1 |
| 2007/0001389 | A1 * | 1/2007 | Goetz | 271/265.04 |
| 2007/0071284 | A1 * | 3/2007 | Philippe et al. | 382/101 |
| 2009/0051108 | A1 * | 2/2009 | Bell | 271/264 |
| 2009/0134568 | A1 | 5/2009 | Berg et al. | |
| 2011/0129324 | A1 * | 6/2011 | Philippe et al. | 414/797.4 |
| 2011/0309572 | A1 * | 12/2011 | Miyamoto | 271/265.04 |

FOREIGN PATENT DOCUMENTS

| | | | |
|---|---|---|---|
| FR | 2692565 | A1 | 12/1993 |
| FR | 2861322 | B1 | 4/2005 |
| JP | 10309535 | A | 11/1998 |
| JP | 2000262976 | A | 9/2000 |
| JP | 2001192147 | A * | 7/2001 |
| WO | 2005108256 | A1 | 11/2005 |

OTHER PUBLICATIONS

International Search Report Issued for PCT/FR2010/050781 Sep. 20, 2010.

* cited by examiner

METHOD OF DETECTING OPEN MAILPIECES SUCH AS NON-WRAPPED MAGAZINES

The invention relates to a method of detecting whether a mailpiece is of the open mailpiece type. The term "open mailpiece" is used herein to mean any flat mail article that is not generally enclosed in an envelope or in a wrapper, and that is made up of a plurality of sheets that are bound together and that can fan out from one another. Such an open mail article can be a bound magazine without any outer wrapper or envelope.

In particular, the invention is applicable to a method of detecting open flat mail articles that are being moved through a mail-handling machine.

In general, in a mail-handling machine, the mailpieces are moved in series and on edge by being nipped between deformable wheels or belts of a conveyor.

The presence of an open mailpiece in the machine can give rise to a jam, and thus to stoppage of the machine. It is therefore important to be able to detect open mailpieces as early as possible in the machine.

For example, a method is known for detecting open mailpieces of the type having cover pages bearing photographs and therefore having outside surfaces that are highly contrasted. By analyzing images of the surfaces of such mailpieces, it is possible to detect a noisy background and, on that basis, to distinguish such mailpieces from other mailpieces. In order to improve the reliability of the detection, a gloss detector is added that is designed to distinguish mailpieces in paper envelopes from mailpieces in wrappers made of plastics materials. Unfortunately, that method suffers from the drawback that open mailpieces (i.e. mailpieces that are not wrapped either in plastic or in paper) that have glossy surfaces can be mistaken for mailpieces having wrappers made of plastic.

An object of the invention is thus to propose a method of detecting open mailpieces that makes it possible to detect such open mailpieces reliably.

To this end, the invention provides a method of detecting a mailpiece of the open mailpiece type such as a non-wrapped magazine, said method being characterized in that it consists in causing the mailpiece to pass on edge through a first conveyor arranged to move the mailpiece by nipping it while holding it tightly over substantially the entire height of the mailpiece, then to pass on edge through a second conveyor arranged to move the mailpiece by nipping it while leaving a top end of the mailpiece free to fan out, and in that two measurements are taken of the thickness of the mailpiece respectively when the mailpiece is in the first conveyor and when it is in the second conveyor, for the purpose of determining, by comparing the measurements, whether the mailpiece is an open mailpiece.

The method of the invention is easy to implement in existing mail-handling machines.

The method of the invention may advantageously have the following features:

- the thickness is measured by means of laser telemeters;
- the thickness measurement in the first conveyor is taken by means of a laser emitter-receiver co-operating with the first conveyor; and
- for the second thickness measurement, a flow of air is directed downwards over the top end of each mailpiece.

These various methods of measuring thickness present the advantage of being capable of being implemented without any direct contact with the mailpieces and without impeding the fanning out of the mailpieces.

The invention extends to a device for detecting a mailpiece of the open mailpiece type such as a non-wrapped magazine, said device being characterized in that it comprises a first conveyor arranged to move the mailpiece by nipping it while holding it tightly over substantially the entire height of the mailpiece, a second conveyor arranged to move the mailpiece on edge by nipping it while leaving a top end of the mailpiece free to fan out, first and second means for taking first and second measurements of the thickness of the mailpiece respectively when the mailpiece is in the first conveyor and when it is in the second conveyor, and a data-processing unit arranged to compare said thickness measurements, and to determine, on the basis of said comparison, whether the mailpiece is an open mailpiece.

The invention also extends to a mail-handling machine including a device of the invention, and in particular, to a mail-sorting machine comprising an unstacker, a sorting conveyor in which the mailpieces are moved in series and on edge at a constant pitch, and a synchronizer interposed between the unstacker and the sorting conveyor to compensate for any differences in pitch between two consecutive mailpieces, wherein the first conveyor for taking the first thickness measurement is part of the synchronizer and the second conveyor for taking the second thickness measurement is part of the sorting conveyor.

The invention is described below in more detail with reference to the accompanying drawings which show non-limiting examples, and in which.

Figure 1:
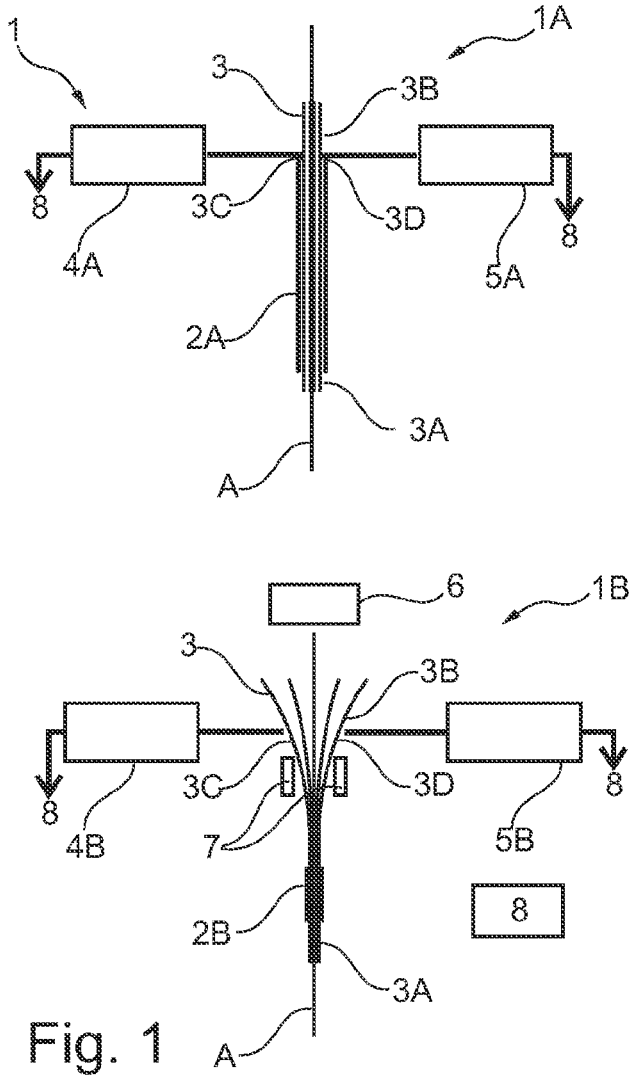
FIG. 1 is a highly diagrammatic view showing an implementation of the method of the invention with an open mailpiece.

The device of the invention is arranged to detect open flat mailpieces. As shown in FIG. 1, the device 1 of the invention has a first portion 1A with a first conveyor 2A arranged to move a mailpiece 3 in series and on edge by nipping it while holding it tightly over the entire height of the mailpiece 3, and a second portion 1B with a second conveyor 2B consecutive to the first conveyor 2A, for conveying mailpieces 3 in series and on edge by nipping them while leaving each of the mailpieces 3 free to fan out at its top end 3B.

In the device 1 of the invention, the order in which the two portions 1A and 1B are disposed along the path of the mailpieces may be reversed.

It can be understood that the second conveyor 2B holds the mailpiece 3 over a small bottom portion of its height only, i.e. by nipping it at its base 3A only, so that its top portion is free to fan out.

The first and second conveyors 2A, 2B may, for example, be in the form of conveyor belts or wheels of the low-pressure type (bladed wheels made of an elastically deformable material and having stationary axes).

As can be seen in FIG. 1, at the first portion 1A, the device 1 has first thickness measurement means for measuring the thickness of each mailpiece while said mailpiece is being moved through the conveyor 2A. These means may be constituted by two laser telemeters 4A, 5A pointing at respective ones of the two faces 3C, 3D of the mailpiece 3 that face in opposite directions away from a reference central axis A. These telemeters are disposed to measure the thickness of the mailpiece at the place where it is held tightly in the conveyor 2A, which place is, in practice, anywhere over its height.

At the second portion 1B, the device 1 also has second thickness measurement means for measuring the thickness of each mailpiece while said mailpiece is being moved through the conveyor 2B. These means may also be constituted by two laser telemeters 4B, 5B pointing at respective ones of the two faces 3C, 3D of the mailpiece 3 that face in opposite directions away from a reference central axis A. These telemeters are disposed to measure the thickness of the mailpiece in its top portion where it is free to fan out because it is not held this high up by the conveyor 2B.

As can be seen in FIG. 1, the device 1 may also include a blower device 6 arranged to direct a flow of air downwards over the top end 3B of each mailpiece 3 in order to encourage and accentuate the fanning out of the top end 3B of the mailpiece 3 in the second conveyor 2B.

It is also possible to provide a guide 7 of the double-slideway type, placed above the second conveyor 2B for limiting the fanning out of each mailpiece so as to avoid it collapsing completely. The guide 7 may, for example, limit the fanning out to about 30 millimeters (mm).

The thickness-measurement signals delivered by the measurement means are transmitted to a data-processing unit 8 arranged for comparing the two measurements of thickness of a mailpiece 3 that are taken respectively when the mailpiece is in the first conveyor 2A and when it is in the second conveyor 2B, and for detecting an open mailpiece when a difference exists between these two measurements.

The first thickness-measurement means 4A, 5A may also be in the form of a laser emitter-receiver that co-operates with the first conveyor 2A. In particular, it is possible to use measurement means as described in Patent Document FR 2 865 800. In those measurement means, the transceiver is mounted in the deformable rim of a low-pressure wheel of the conveyor 2A and it uses the reflection of the laser signal off a reflective inside surface of the wheel.

Figure 2:
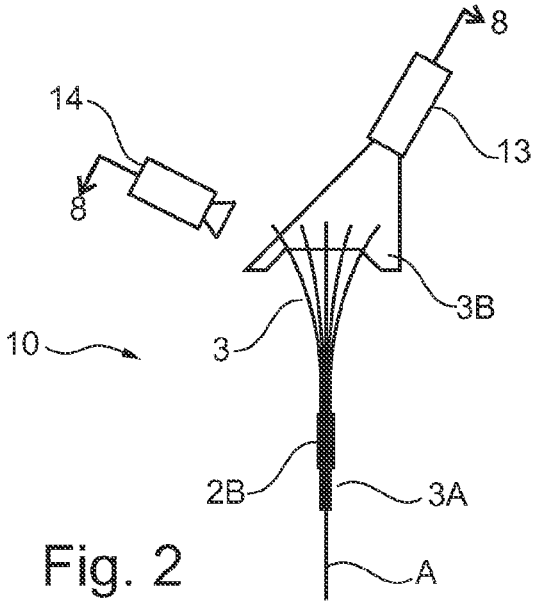
FIG. 2 is a highly diagrammatic view showing another implementation of the method of the invention.

FIG. 2 shows a light emitter 13 that emits a structured light beam onto the top end 3B of the mailpiece 3 that is free to fan out, and a camera 14 that is arranged to form a digital image of the top end 3B of the mailpiece that includes the rays reflected by the sheets of the mailpiece 3. The camera 14 may be placed above the mailpiece 3 or on one side of the mailpiece 3, namely in front of or behind said mailpiece. In this situation, the data-processing unit 8 is arranged to analyze the image delivered by the camera 14, e.g. to determine a profile of the top end of the mailpiece. The result of this analysis is used to supplement the detection performed by comparing thickness measurements in the conveyors 2A and 2B. This image analysis result may, for example, serve to reinforce or to validate/invalidate the decision that a mailpiece of the open type has been detected, which decision is delivered by the above-described differential measurement.

Figure 3:
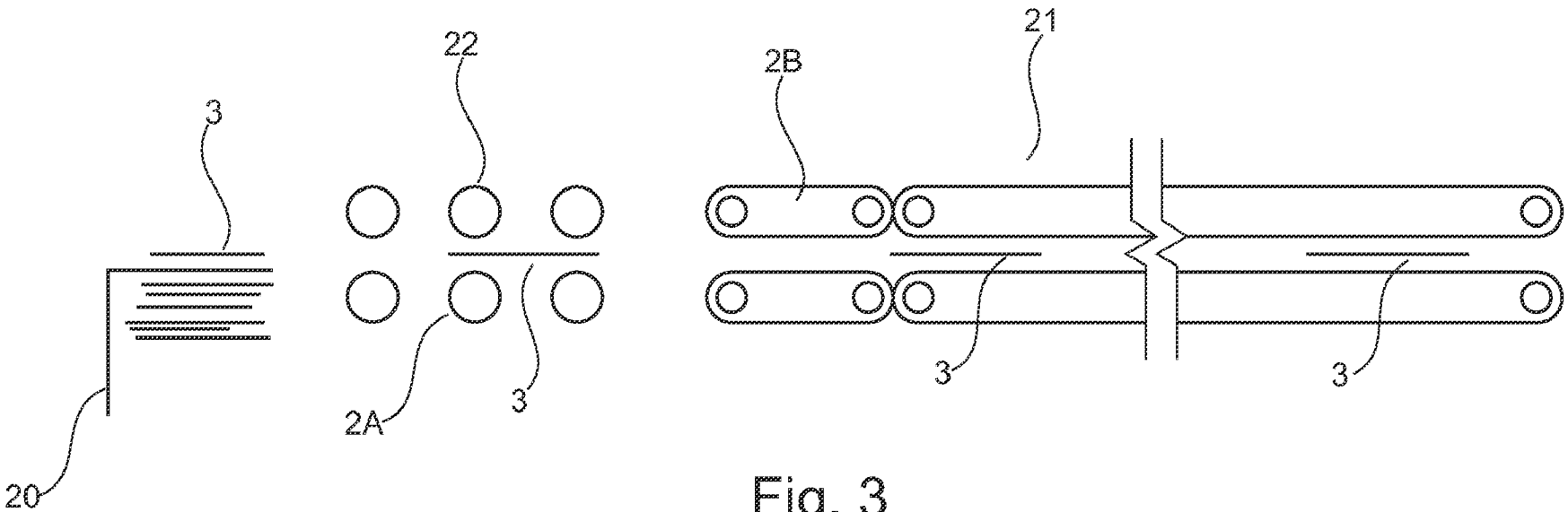
FIG. 3 is a diagrammatic plan view of a postal sorting machine incorporating a device for detecting open mailpieces.

FIG. 3 shows a mail-handling machine using the device 1 of the invention. This machine is more particularly a mail-handling machine including an unstacker 20, a sorting conveyor 21, e.g. having superposed belts, in which the mailpieces 3 in series and on edge are moved at constant pitch (distance between leading edges of two consecutive mailpieces), and a synchronizer 22 interposed between the unstacker 20 and the sorting conveyor 21 that compensates for differences in pitch between consecutive mailpieces 3. In this arrangement, the first conveyor 2A of the device 1 of the invention may be an integral part of the synchronizer 22 made up of a plurality of trains of low-pressure wheels, in particular trains of wheels having a plurality of wheel stages. The second conveyor 2B of the device 1 of the invention may be an integral part of the sorting conveyor 21, in particular in the form of a portion thereof having a single belt over its height.

In accordance with the invention, in order to detect an open mailpiece that is being moved through a sorting machine of FIG. 3, the mailpiece is moved on edge through the first conveyor 2A that holds the mailpiece tightly over substantially all of its height, thereby preventing it from fanning out. A first measurement of the thickness of this mailpiece is taken while it is being moved through the first conveyor. Then the mailpiece is moved on edge through the second conveyor 2B that holds the mailpiece in its bottom portion 3A only, while leaving the top portion 3B of the mailpiece free to fan out. In general, the speed of movement of the mailpieces through the sorting machine is sufficient to force an open mailpiece to fan out in the second conveyor 2B. The thickness of the mailpiece is measured in its top portion when it is in the second conveyor. For open mailpieces, a thickness measurement difference is obtained that is sufficiently large to be detected without any ambiguity.

In practice, in a mail-handling machine, the first conveyor 2A is dimensioned to hold C4-format and C5-format mailpieces on edge over their entire heights. The second conveyor 2B is dimensioned to leave each mailpiece free at a height of about 90 mm measured from the base of the mailpiece.

In FIG. 1, it can be seen that two thickness measurements are taken substantially at the same height relative to the bases 3A of the mailpieces and, for example, at about 150 mm above the bases 3A of the mailpieces, thereby corresponding to the height of a C5-format mailpiece. It is possible to consider taking a plurality of thickness measurements that are superposed in the height direction for the purpose of performing the second thickness measurement in order to take account of a broad spectrum of open mailpieces to be detected.

The detection device 1 thus makes it possible to increase the reliability of detection of open mailpieces, and may be used in a postal sorting machine in combination, for example, with other detection means such as inductive sensors for detecting staples, gloss sensors for detecting the contrast of the mailpieces, or contrast sensors for detecting high-contrast covers.

The invention claimed is:

1. A method of detecting a mailpiece of the open mailpiece type such as a non-wrapped magazine, said method being characterized in that it consists in causing the mailpiece (3) to pass on edge through a first conveyor (2A) arranged to move the mailpiece (3) by nipping it while holding it tightly over substantially the entire height of the mailpiece, then to pass on edge through a second conveyor (2B) arranged to move the mailpiece (3) by nipping it while leaving a top end (3B) of the mailpiece free to fan out, and in that two measurements are taken of the thickness of the mailpiece (3) respectively when the mailpiece is in the first conveyor (2A) and when it is in the second conveyor (2B), for the purpose of determining, by comparing the measurements, whether the mailpiece is an open mailpiece.

2. A method according to claim 1, wherein the thickness is measured by means of laser telemeters (4A, 5A, 4B, 5B).

3. A method according to claim 1, wherein the thickness measurement in the first conveyor (2A) is taken by means of a laser emitter-receiver co-operating with the first conveyor (2A).

4. A method according to claim 1, wherein an image of the top end (3B) of the mailpiece that is left free to fan out is analyzed in order to supplement detection of an open mailpiece, which detection is delivered by said comparing of measurements.

5. A method according to claim 1, wherein, for the second thickness measurement, a flow of air is directed downwards over the top end (3B) of each mailpiece (3).

6. A device (1) for detecting a mailpiece of the open mailpiece type such as a non-wrapped magazine, said device being characterized in that it comprises a first conveyor (2A) arranged to move the mailpiece (3) by nipping it while holding it tightly over substantially the entire height of the mailpiece, a second conveyor (2B) arranged to move the mailpiece (3) on edge by nipping it while leaving a top end (3B) of the mailpiece (3) free to fan out, first and second means (4A, 5A, 4B, 5B) for taking first and second measurements of the thickness of the mailpiece respectively when the mailpiece (3) is in the first conveyor (2A) and when it is in the second conveyor (2B), and a data-processing unit (8) arranged to compare said thickness measurements, and to determine, on the basis of said comparison, whether the mailpiece is an open mailpiece.

7. The device according to claim 6, including at least one laser telemeter (4A, 5A, 4B, 5B) for measuring the thickness.

8. The device according to claim 6, including, in the first conveyor (2A), a laser emitter-receiver co-operating with the first conveyor (2A) for measuring the thickness.

9. The device according to claim 6, including, in the second conveyor (2B), a camera (14) and a divergent light beam (13) for measuring the thickness.

10. The device according to claim 6, also including, in the second conveyor (2B), a blower device (6) arranged to direct a flow of air downwards over the top end (3B) of each mailpiece (3).

11. A mail-handling machine, characterized in that it includes a device (1) according to claim 6.

12. A mail-handling machine according to claim 11, comprising an unstacker (20), a sorting conveyor (21) in which the mailpieces (3) are moved in series and on edge at a constant pitch, and a synchronizer (22) interposed between the unstacker (20) and the sorting conveyor (21) to compensate for any differences in pitch between two consecutive mailpieces (3), wherein the first conveyor (2A) for taking the first thickness measurement is part of the synchronizer (22) and the second conveyor (2B) for taking the second thickness measurement is part of the sorting conveyor (21).

* * * * *